US008198499B2

(12) United States Patent
Luo et al.

(10) Patent No.: US 8,198,499 B2
(45) Date of Patent: Jun. 12, 2012

(54) IONIC LIQUID CATALYZED ALKYLATION PROCESS EMPLOYING NOZZLES AND SYSTEM IMPLEMENTING SUCH PROCESS

(75) Inventors: Huping Luo, Richmond, CA (US); Abdenour Kemoun, Pleasant Hill, CA (US); Hye-Kyung Timken, Albany, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 613 days.

(21) Appl. No.: 12/003,574

(22) Filed: Dec. 28, 2007

(65) Prior Publication Data

US 2009/0166257 A1 Jul. 2, 2009

(51) Int. Cl.
*C07C 2/60* (2006.01)

(52) U.S. Cl. ..... 585/720; 585/716; 585/721; 585/727; 585/728; 585/729

(58) Field of Classification Search ..... 422/236, 422/224; 585/721, 723, 727, 728, 301, 716, 585/720, 729
See application file for complete search history.

(56) References Cited

U.S. PATENT DOCUMENTS

| | | | | |
|---|---|---|---|---|
| 3,696,168 | A * | 10/1972 | Vanderveen | 585/720 |
| 3,758,613 | A * | 9/1973 | Anderson | 585/711 |
| 3,925,502 | A * | 12/1975 | Boney et al. | 585/720 |
| 5,345,027 | A * | 9/1994 | Child et al. | 585/720 |
| 5,648,586 | A * | 7/1997 | Sampath | 585/716 |
| 5,750,455 | A | 5/1998 | Chauvin et al. | |
| 5,777,189 | A * | 7/1998 | Alexanyan et al. | 585/709 |
| 6,028,024 | A | 2/2000 | Hirschauer et al. | |
| 6,106,789 | A | 8/2000 | Thompson et al. | |
| 2003/0060359 | A1 | 3/2003 | Olivier-Bourbigou et al. | |
| 2004/0077914 | A1 * | 4/2004 | Zavilla et al. | 585/737 |
| 2005/0119423 | A1 * | 6/2005 | Bergman et al. | 526/68 |
| 2006/0131209 | A1 | 6/2006 | Timken et al. | |
| 2006/0135839 | A1 * | 6/2006 | Elomari et al. | 585/721 |

FOREIGN PATENT DOCUMENTS

| | | |
|---|---|---|
| KR | 20070091346 | 9/2007 |
| WO | WO98/31454 | 7/1998 |
| WO | WO 2006 073749 | 7/2006 |

OTHER PUBLICATIONS

Meindersma, et al., "Ionic Liquids" in Ullmann's Encyclopedia of Industrial Chemistry, Wiley-VCH, 2007, available on-line Jul. 15, 2007.*

Roebuck, A,.K. and Evering, B.L., "Isobutane-Olefin Alkylation with Inhibited Aluminum Chloride Catalysts" Ind. Eng. Chem,. Prod. Res. Develop., publ. , vol. 9, pp. 76-82 (1970).

U.S. Appl. No. 12/003,576, filed Dec. 28, 2007 for "Ionic Liquid Catalyst Alkylation Using a Loop Reactor", inventors Luo et al.

(Continued)

*Primary Examiner* — In Suk Bullock
*Assistant Examiner* — Bradley Etherton
(74) *Attorney, Agent, or Firm* — Merchant & Gould

(57) ABSTRACT

A process for a liquid/liquid reaction employs a nozzle dispersion whereby liquid reactants and liquid catalyst are injected through at least one nozzle into a reaction zone to effect a reaction. The reaction can be alkylation of at least one isoparaffin with at least one olefin in the presence of an ionic liquid catalyst. The at least one nozzle provides intimate contact between the phases for greater product control and reaction control.

16 Claims, 2 Drawing Sheets

OTHER PUBLICATIONS

U.S. Appl. No. 12/003,580, filed Dec. 28, 2007 for Ionic Liquid Catalyst Alkylation Using Split Reactant Streams, inventors Luo et al.

ISR from PCT/US2008/084132 mailed Apr. 10, 2009 in the corresponding International Application.

PCT/US2008/084132 Search Report and Written Opinion, 8 pages, Dated Apr. 10, 2009.

* cited by examiner

IONIC LIQUID CATALYZED ALKYLATION PROCESS EMPLOYING NOZZLES AND SYSTEM IMPLEMENTING SUCH PROCESS

FIELD OF ART

The process as described herein relates to nozzle dispersion of liquid reactants and liquid catalyst to produce a reaction product. The process as described more specifically relates to an ionic liquid catalyzed alkylation process utilizing nozzle dispersion to produce a product comprising low volatility, high quality gasoline blending components.

BACKGROUND

Modern refineries employ many upgrading unit processes such as fluidic catalytic cracking (FCC), hydrocracking (HCR), alkylation, and paraffin isomerization. As a result, these refineries produce a significant amount of isopentane. Historically, isopentane was a desirable blending component for gasoline having a high octane rating (92 RON), although it exhibited high volatility (20.4 Reid vapor pressure (RVP)). As environmental laws began to place more stringent restrictions on gasoline volatility, the use of isopentane in gasoline was limited because of its high volatility. As a consequence, the problem of finding uses for by-product isopentane became serious, especially during the hot summer season. Moreover, as more gasoline compositions contain ethanol instead of MTBE as their oxygenate component, more isopentane had to be kept out of the gasoline pool in order to meet the gasoline volatility specification. Thus, gasoline volatility became an even more serious problem and limited the usefulness of isopentane as a gasoline blending component.

A novel alkylation process, which is disclosed in U.S. Patent Application Publication 2006/0131209 ("the '209 publication"), was developed whereby undesirable, excess isopentane is converted into desirable and much more valuable low-RVP gasoline blending components. The contents of the '209 publication incorporated by reference herein in their entirety. This alkylation process involves contacting isoparaffins, preferably isopentane, with olefins, preferably ethylene, in the presence of an ionic liquid catalyst to produce the low-RVP gasoline blending components. This process eliminates the need to store or otherwise use by-product isopentane and eliminates concerns associated with such storage and usage. Furthermore, the ionic liquid catalyst in this process can also be used with conventional alkylation feed components (e.g. isobutane, propylene, butene, and pentene).

The ionic liquid catalyst distinguishes this novel alkylation process from conventional processes that convert light paraffins and light olefins to more lucrative products such as the alkylation of isoparaffins with olefins and the polymerization of olefins. For example, one of the most extensively used processes is the alkylation of isobutane with $C_3$-$C_5$ olefins to make gasoline cuts with high octane numbers. However, all conventional alkylation processes employ sulfuric acid ($H_2SO_4$) and hydrofluoric acid (HF) catalysts.

Numerous disadvantages are associated with the use of $H_2SO_4$ and HF catalysts. Extremely large amounts of acid are necessary to initially fill the reactor. A $H_2SO_4$ plant also requires a huge amount of daily withdrawal of spent acid for off-site regeneration, which involves incinerating the spent $H_2SO_4$ to recover $SO_2/SO_3$ and preparing fresh $H_2SO_4$. While an HF alkylation plant has on-site regeneration capability and daily make-up of HF is orders of magnitude less, HF forms aerosol. Aerosol formation presents a potentially significant environmental risk and also makes the HF alkylation more dangerous than the $H_2SO_4$ alkylation. This is evident from additional safety measures associated with modern HF alkylation processes such as water spray and catalyst additive for aerosol reduction. The ionic liquid catalyst alkylation process overcomes such disadvantages and fulfills the apparent need for safer and more environmentally-friendly catalyst systems.

Benefits of the ionic liquid catalyst alkylation process include the following:

(1) significant environmental, health and safety advantages;

(2) substantial reduction in capital expenditure as compared to $H_2SO_4$ and HF alkylation plants;

(3) substantial reduction in operating expenditures as compared to $H_2SO_4$ alkylation plants;

(4) substantial reduction in catalyst inventory volume (potentially by 90%);

(5) substantial reduction in catalyst make-up rate (potentially by 98% compared to $H_2SO_4$ plants);

(6) higher gasoline yield;

(7) comparable or better product quality (Octane number, RVP, T50);

(8) expansion of alkylation feeds to include isopentane and ethylene; and (9) higher activity and selectivity of the catalyst.

Ionic liquid catalysts specifically useful in the alkylation process described in the '209 publication are disclosed in U.S. Patent Application Publication 2006/0135839 ("the '839 publication"), which is also incorporated by reference in its entirety herein. Such catalysts include a chloroaluminate ionic liquid catalyst comprising a hydrocarbyl substituted pyridinium halide of the general formula A below and aluminum trichloride or a hydrocarbyl substituted imidazolium halide of the general formula B below and aluminum trichloride. To prepare this chloroaluminate ionic liquid catalyst, 1 molar equivalent hydrocarbyl substituted pyridinium halide or hydrocarbyl substituted imidazolium halide can be combined with 2 molar equivalents aluminum trichloride. Such catalysts further include a chloroaluminate ionic liquid catalyst comprising an alkyl substituted pyridinium halide of the general formula A below and aluminum trichloride or an alkyl substituted imidazolium halide of the general formula B below and aluminum trichloride. To prepare this chloroaluminate ionic liquid catalyst, 1 molar equivalent alkyl substituted pyridinium halide or alkyl substituted imidazolium halide can be combined with 2 molar equivalents aluminum trichloride.

(A)

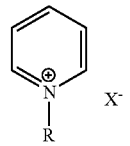

(B)

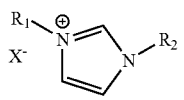

wherein R=H, methyl, ethyl, propyl, butyl, pentyl or hexyl group and X is a haloaluminate and preferably a chloroaluminate, and $R_1$ and $R_2$=H, methyl, ethyl, propyl, butyl, pentyl, or hexyl group and where $R_1$ and $R_2$ may or may not be the same. Preferred chloroaluminate ionic liquid catalysts include 1-butyl-4-methyl-pyridinium chloroaluminate (BMP), 1-butyl-pyridinium chloroaluminate (BP), 1-butyl-3-methyl-imidazolium chloroaluminate (BMIM) and 1-H-pyridinium chloroaluminate (HP).

However, ionic liquid catalysts have unique properties making it necessary to further develop and modify the ionic liquid catalyzed alkylation process in order to achieve superior gasoline blending component products, improved process operability and reliability, reduced operating costs, etc. One of the unique properties of an ionic liquid catalyst is its much higher activity in catalyzing alkylation reactions than conventional sulfuric acid and hydrofluoric acid catalysts.

In conventional alkylation processes, due to relatively low catalyst activity, a large amount of acid catalyst has to be used in the system, for example, 50-60 vol %. As a result, the acid catalyst forms a continuous phase in the alkylation reactor while the hydrocarbon reactants (i.e., isoparaffin and olefin) form a dispersed phase or small droplets suspended in the acid phase. In this liquid-liquid dispersion, a large interfacial area between the catalyst continuous phase and the hydrocarbon dispersed phase can be achieved by conventional emulsifying techniques, such as high speed stirring and static mixing.

In contrast, in the ionic liquid alkylation process, a much smaller amount of ionic liquid catalyst is needed to catalyze the reactions with high selectivity. Usually, a 5-10 vol % of ionic liquid catalyst is sufficient to catalyze the reactions between isoparaffin and olefin. Under such conditions, the hydrocarbon phase forms a continuous phase while the ionic liquid forms a dispersed phase or small droplets suspended in the hydrocarbon phase. This liquid-liquid dispersion requires highly intimate contact between the catalyst and the hydrocarbon phases. Due to the low inventory of ionic liquid catalyst in the reactor system, a large interfacial area between the two liquid phases cannot be achieved by conventional emulsifying techniques. Due to the large density difference between the ionic liquid catalyst and hydrocarbon phase, ionic liquid droplets, if not small enough, will quickly settle down and be segregated from the hydrocarbon phase, resulting in a very short contact time between the phases that is not sufficient to catalyze the alkylation reaction. Finally, due to the relatively large vol % of hydrocarbon phase in the reactor, good mixing is required to homogenize the hydrocarbon phase and achieve a uniform composition of the hydrocarbon phase and a uniform temperature gradient throughout the reactor.

Thus, the ionic liquid catalyst alkylation process requires intimate mixing of the hydrocarbons and catalyst, sufficient interfacial contact between the hydrocarbons and catalyst, minimal residence time distribution, good temperature and pressure control, and a high isoparaffin to olefin (I/O) ratio. The ionic liquid alkylation process is also a highly exothermic reaction necessitating prompt heat removal.

WO Patent No. 98/31454 discloses a reactor system using a static mixer to emulsify sulfuric acid and hydrocarbon feeds in a sulfuric acid alkylation process. It also discloses several sulfuric acid alkylation processes using a high speed stirrer to emulsify feeds. However, it is well known that a high speed stirrer is not energy efficient in emulsifying a liquid-liquid system. This is especially true for the ionic liquid catalyzed alkylation process, where a small amount of much heavier and more viscous ionic liquid phase must be emulsified in a light hydrocarbon phase. As for the static mixer, it is also well known that a very high linear liquid velocity is required to emulsify liquid-liquid systems resulting in an prohibitively high pressure drop across the static mixer.

Above all, the ionic liquid catalyzed alkylation process is a unique process as compared to other conventional alkylation processes. There remains a need, however, to emulsify the ionic liquid and the hydrocarbon phase to achieve intimate contact between the phases for greater alkylation product quality and reaction control.

U.S. Pat. No. 3,696,168 ("Vanderveen") discloses the use of several nozzles assembled into a compound nozzle system in an alkylation process using HF catalyst to achieve an increase in octane number and a related reduction in overall reaction temperature in addition to a reduction in temperature at immediate or exact point of contact between the hydrocarbons and the catalyst. A series of adjacently disposed nozzles spray fresh catalyst-free isoparaffin, fresh catalyst-free olefin, and recycled isoparaffin containing catalyst into a main body of catalyst where the alkylation reaction occurs. More particularly, a first conduit containing fresh isoparaffin, a second conduit containing fresh olefin, and a third conduit containing recycled isoparaffin are split into a series of conduits that carry a portion of each of the fresh isoparaffin, the fresh olefin, and the recycled isoparaffin to the nozzles. Each nozzle is constructed such that the isoparaffin and olefin pass through a centrally or axially disposed feed nozzle and the recycled isobutane passes through at least one subordinate or auxiliary feed nozzle next to the centrally disposed feed nozzle, wherein the feed nozzles are located within a cap or mantle.

While the teachings of Vanderveen impart certain benefits to the HF catalyzed alkylation process, there still exists a need for an improved alkylation process for converting isoparaffins and olefins in the presence of an ionic liquid catalyst.

SUMMARY

Disclosed herein is an improved process for a liquid/liquid reaction. More particularly, disclosed herein is an improved ionic liquid catalyst alkylation process for producing low volatility, high quality gasoline blending components.

The improved process for a liquid/liquid reaction comprises injecting liquid reactants and liquid catalyst through the same at least one nozzle. Thus, the liquid reactants and catalyst may both be injected through one nozzle, two nozzles, three nozzles, etc. The at least one nozzle injects the liquid reactants and catalyst into a reaction zone, where the liquid reactants react in the presence of the liquid catalyst to form a reaction product. It has been found that by employing the at least one nozzle and controlling the reaction in the at least one nozzle, one can obtain excellent mixing, interfacial contact, and reaction between liquid reactants and liquid catalyst.

Among other factors, assisted by the high liquid speeds in the at least one nozzle, dispersing the liquid reactants and liquid catalyst through the at least one nozzle creates a zone within the at least one nozzle with very high shear stress and mass transfer rates that greatly enhances mixing of the reactants and catalyst, increases interfacial contact between the reactants and catalyst, minimizes residence time distribution within the reaction zone, and permits good temperature and pressure control within the reaction zone.

According to an embodiment of the process as described herein, the nozzle(s) can have dimensions compatible to the feed liquid rates to obtain relatively uniform droplet sizes of the liquid catalyst. Droplet size is important. If the droplet size is too big, there will be insufficient interfacial area between the phases. If the droplet size is too small, separating both phases in a downstream process will be difficult.

In another embodiment of the process as described herein, the at least one nozzle can be designed or arranged inside the reactor to achieve the greatest back mixing in the reaction zone or overall reactor outside of the at least one nozzle.

An efficient ionic liquid catalyzed alkylation process requires good mixing and a great deal of interfacial contact between the hydrocarbons and catalyst. Since the improved process for a liquid/liquid reaction achieves excellent mixing interfacial contact between the liquid reactants and catalyst, a particular embodiment of the improved process for a liquid/liquid reaction involves alkylation of isoparaffin and olefin in the presence of an ionic liquid catalyst. More particularly, this embodiment is an improved ionic liquid catalyzed alkylation process for producing low volatility, high quality gasoline blending components.

The ionic liquid catalyzed alkylation process for producing low volatility, high quality gasoline blending components comprises injecting at least one isoparaffin, at least one olefin, and an ionic liquid catalyst through the same at least one nozzle. Thus, the at least one isoparaffin, the at least one olefin, and the ionic liquid catalyst may all be injected through one nozzle, two nozzles, three nozzles, etc. The at least one isoparaffin, the at least one olefin, and the ionic liquid catalyst are all in liquid form. The nozzle(s) inject the three liquids into a reaction zone under alkylation conditions, where the at least one isoparaffin alkylates the at least one olefin in the presence of the ionic liquid catalyst to form a product comprising low volatility, high quality gasoline blending components.

Among other factors, injecting the hydrocarbons and catalyst all through the same at least one nozzle enhances mixing of the hydrocarbons and catalyst, increases interfacial contact between the hydrocarbons and catalyst, minimizes residence time distribution within the reaction zone, permits good temperature and pressure control within the reaction zone, and also enhances the isoparaffin to olefin (I/O) ratio.

DETAILED DESCRIPTION

Definitions

Figure 1:
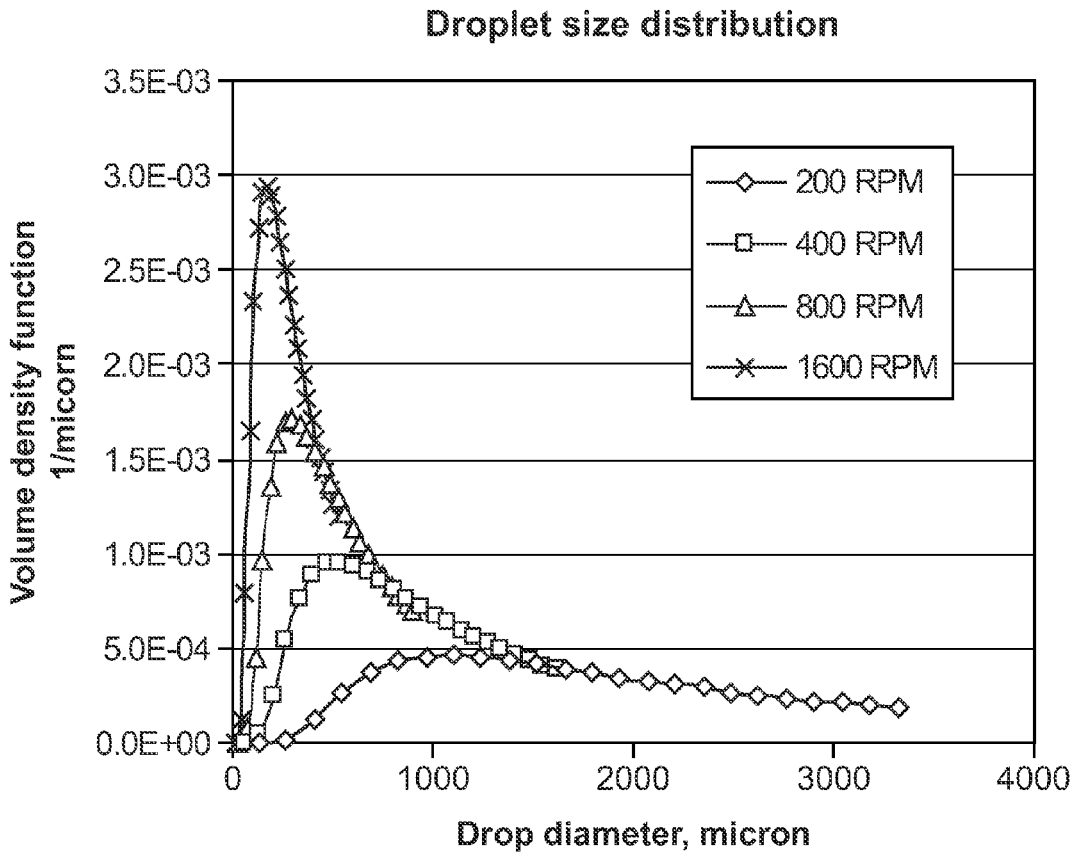
FIG. 1 graphically depicts the effect of revolutions per minute (RPM) on droplet size distribution as estimated by a Visimix simulation in Example 2.

As used herein, the term "isoparaffin" means any branched-chain saturated hydrocarbon compound, i.e. a branched-chain alkane with a chemical formula of $C_nH_{2n+2}$. Examples of isoparaffins are isobutane and isopentane.

The term "olefin" means any unsaturated hydrocarbon compound having at least one carbon-to-carbon double bond, i.e. an alkene with a chemical formula of $C_nH_{2n}$. Examples of olefins include ethylene, propylene, butene, and so on.

Process

According to its broadest aspect, a process as disclosed herein produces a product from a reaction between liquid reactants and a liquid catalyst. This process involves injecting the liquid reactants and liquid catalyst through the same at least one nozzle into a reaction zone under reaction conditions to provide the product.

The liquid reactants and liquid catalyst can be injected through a single nozzle into the reaction zone or, alternatively, the liquid reactants and liquid catalyst can be injected through a plurality of nozzles into the reaction zone. In other words, there can be more than one nozzle leading to the reaction zone. However, in either case, both liquid reactants and liquid catalyst are sent through each nozzle. Liquid reactants are not injected through one nozzle, while liquid catalyst is injected through a separate nozzle. It is important that the liquid reactants and liquid catalyst are injected through the same nozzle. In this manner, the liquid reactants and liquid catalyst contact one another in the nozzle chamber before being sprayed into the reaction zone. Nozzle injection achieves good mixing and interfacial contact between the liquid reactants and liquid catalyst, which in turn achieves a better, more efficient reaction.

In one embodiment, the liquid reactants and liquid catalyst can have a short residence time within the at least one nozzle. This may be accomplished by sending the liquid reactants and liquid catalyst through the nozzle(s) at a relatively high flow rate and/or using nozzle(s) designed to shorten the residence time. For example, a nozzle with a shorter chamber or smaller chamber has a shorter residence time than a nozzle having a longer chamber or larger chamber. If the reaction between the liquid reactants and liquid catalyst is exothermic, a short residence time within the nozzle(s) is especially desirable and perhaps necessary for the nozzle(s) to retain their structural integrity.

In another embodiment, the at least one nozzle can have dimensions compatible to the feed liquid rates to obtain relatively uniform droplet sizes of the liquid catalyst. Droplet size is important. If the droplet size is too big, there will be insufficient interfacial area between the phases. If the droplet size is too small, separating both phases in a downstream process will be difficult.

In yet another embodiment, the at least one nozzle can be designed or arranged inside the reactor to achieve the greatest back mixing in the reaction zone or overall reactor outside of the at least one nozzle.

According to another aspect, the process as disclosed herein produces a process a particular product from particular liquid reactants and catalyst. More specifically, the process produces low volatility, high quality gasoline blending components by reacting at least one isoparaffin and at least one olefin, both in liquid form, and an ionic liquid catalyst. The process involves injecting the at least one isoparaffin, the at least one olefin, and the ionic liquid catalyst through at least one nozzle so that the at least one isoparaffin, the at least one olefin, and the ionic liquid catalyst pass through the same nozzle. The at least one nozzle may be a single nozzle or a plurality of nozzles (e.g. two, three, four, etc). However, no matter how many nozzles are utilized, the at least one isoparaffin, the at least one olefin, and the ionic liquid catalyst are sent through the nozzle(s) together. Typically, the at least one isoparaffin, the at least one olefin, and the ionic liquid catalyst are injected simultaneously through the at least one nozzle.

This process is significantly different from the nozzle structure and arrangement for producing high octane alkylate described in U.S. Pat. No. 3,696,168 to Vanderveen, where catalyst is not nozzle injected.

If more than one nozzle is used, the at least one isoparaffin, the at least one olefin, and the ionic liquid catalyst can be injected through the multiple nozzles concurrently. For example, if there are two nozzles, the three materials can be injected through the first nozzle at the same time as the three materials are injected through the second nozzle.

The spray action of the nozzle(s) breaks the at least one isoparaffin, the at least one olefin, and the ionic liquid catalyst into tiny droplets. Therefore, the nozzle(s) achieve in superior mixing and interfacial contact between the at least one isoparaffin, the at least one olefin, and the ionic liquid catalyst than mixing and interfacial contact achieved by conventional alkylation processes. Such superior mixing and interfacial contact results in a more efficient alkylation reaction. Additionally, the nozzle(s) provide high isoparaffin to olefin (I/O) ratio throughout the reaction zone and good temperature and pressure control throughout the reaction zone.

Once the at least one isoparaffin, the at least one olefin, and the ionic liquid catalyst are injected through the at least one nozzle, they enter a reaction zone under alkylation conditions. Here, the at least one isoparaffin and the at least one olefin react in the presence of the ionic liquid catalyst to produce a product containing low volatility, high quality gasoline blending components.

The process can further comprise removing the product comprising gasoline blending components from the reaction zone and isolating the gasoline blending components.

The alkylation reaction between the at least one isoparaffin and the at least one olefin is severely exothermic. If too much alkylation were to occur within the nozzle(s), the temperature of the nozzle(s) could rise to too high a level severely hindering the reaction selectivity. This situation can be avoided by minimizing the reaction that takes place within the chamber of the nozzle(s). For example, the residence time of the at least one isoparaffin, the at least one olefin, and the ionic liquid catalyst within the nozzle(s) can be minimized by increasing the flow rate of the at least one isoparaffin, the at least one olefin, and the ionic liquid catalyst through the nozzle(s), shortening the length of the nozzle(s), minimizing the size of the nozzle(s), etc. Therefore, in one embodiment of the process as described herein, the majority of the alkylation reaction occurs outside of the nozzle(s) and within the reaction zone.

The nozzle(s) are positioned within a reaction zone. In one embodiment, the nozzle(s) are disposed within a single reactor. Additionally, the nozzle(s) may be arranged in any manner within the reaction zone.

The reaction zone can comprise a plurality of reaction cells provided that at least one nozzle (i.e. one or more nozzles) is contained within each reaction cell. Such reaction cells can be contained with a single reactor or can be divided between a plurality of reactors. The reactor(s) can be of any type including a continuous-stirred tank reactor(s) (CSTRs).

If the nozzle(s) are positioned within in a CSTR, they inject the hydrocarbons into a bulk liquid phase of the hydrocarbons, ionic liquid catalyst, and product. In such a case, the nozzle(s) mix the hydrocarbons and catalyst, as well as the bulk liquid phase.

Hydrocarbons

The at least one isoparaffin can comprise isobutane, isopentane, or mixtures thereof. The at least one olefin can comprise ethylene, propylene, butene, pentene, or mixtures thereof.

Ionic Liquid Catalyst

Ionic liquid catalysts are well known in the art. The process as described herein can employ a catalyst composition comprising at least one aluminum halide such as aluminum chloride, at least one quaternary ammonium halide and/or at least one amine halohydrate, and at least one cuprous compound. Such a catalyst composition and its preparation is disclosed in U.S. Pat. No. 5,750,455, which is incorporated by reference in its entirety herein.

Alternatively, the ionic liquid catalyst can be a pyridinium or imidazolium-based chloroaluminate ionic liquid. These ionic liquids have been found to be much more effective in the alkylation of isopentane and isobutane with ethylene than aliphatic ammonium chloroaluminate ionic liquid (such as tributyl-methyl-ammonium chloroaluminate). The ionic liquid catalyst can be (1) a chloroaluminate ionic liquid catalyst comprising a hydrocarbyl substituted pyridinium halide of the general formula A below and aluminum trichloride or (2) a chloroaluminate ionic liquid catalyst comprising a hydrocarbyl substituted imidazolium halide of the general formula B below and aluminum trichloride. Such a chloroaluminate ionic liquid catalyst can be prepared by combining 1 molar equivalent hydrocarbyl substituted pyridinium halide or hydrocarbyl substituted imidazolium halide with 2 molar equivalents aluminum trichloride. The ionic liquid catalyst can also be (1) a chloroaluminate ionic liquid catalyst comprising an alkyl substituted pyridinium halide of the general formula A below and aluminum trichloride or (2) a chloroaluminate ionic liquid catalyst comprising an alkyl substituted imidazolium halide of the general formula B below and aluminum trichloride. Such a chloroaluminate ionic liquid catalyst can be prepared by combining 1 molar equivalent alkyl substituted pyridinium halide or alkyl substituted imidazolium halide to 2 molar equivalents of aluminum trichloride.

(A)

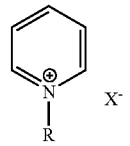

(B)

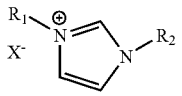

wherein R=H, methyl, ethyl, propyl, butyl, pentyl or hexyl group and X is a haloaluminate and preferably a chloroaluminate, and $R_1$ and $R_2$=H, methyl, ethyl, propyl, butyl, pentyl, or hexyl group and where $R_1$ and $R_2$ may or may not be the same.

The ionic liquid catalyst can also be mixtures of these chloroaluminate ionic liquid catalysts. Preferred chloroaluminate ionic liquid catalysts are 1-butyl-4-methyl-pyridinium chloroaluminate (BMP), 1-butyl-pyridinium chloroaluminate (BP), 1-butyl-3-methyl-imidazolium chloroaluminate (BMIM), 1-H-pyridinium chloroaluminate (HP), and N-butylpyridinium chloroaluminate ($C_5H_5C_4H_9Al_2Cl_7$), and mixtures thereof.

A metal halide may be employed as a co-catalyst to modify the catalyst activity and selectivity. Commonly used halides for such purposes include NaCl, LiCl, KCl, $BeCl_2$, $CaCl_2$, $BaCl_2$, $SiCl_2$, $MgCl_2$, $PbCl_2$, CuCl, $ZrCl_4$, and AgCl as published by Roebuck and Evering (Ind. Eng. Chem. Prod. Res. Develop., Vol. 9, 77, 1970), which is incorporated by reference in its entirety herein. Especially useful metal halides are CuCl, AgCl, $PbCl_2$, LiCl, and $ZrCl_4$. Another useful metal halide is $AlCl_3$.

HCl or any Broensted acid may be employed as an effective co-catalyst to enhance the activity of the catalyst by boosting the overall acidity of the ionic liquid-based catalyst. The use of such co-catalysts and ionic liquid catalysts that are useful in practicing the present process are disclosed in U.S. Published Patent Application Nos. 2003/0060359 and 2004/0077914, the disclosures of which are herein incorporated by reference in their entirety. Other co-catalysts that may be used to enhance the catalytic activity of the ionic liquid catalyst include IVB metal compounds preferably IVB metal halides such as $TiCl_3$, $TiCl_4$, $TiBr_3$, $TiBr_4$, $ZrCl_4$, $ZrBr_4$, $HfCl_4$, and $HfBr_4$ as described by Hirschauer et al. in U.S. Pat. No. 6,028,024, which document is incorporated by reference in its entirety herein.

Alkylation Conditions

Alkylation conditions are maintained in the reaction zone. The molar ratio between the at least one isoparaffin and the at least one olefin can be in the range of 1 to 100. Alternatively, the molar ratio between the at least one isoparaffin and the at least one olefin can be in the range of 2 to 50. As another alternative, the molar ratio between the at least one isoparaffin and the at least one olefin can be in the range of 2 to 20. Catalyst volume in the reactor can be in the range of 2 vol % to 70 vol %. Alternatively, catalyst volume in the reactor can be in the range of 5 vol % to 50 vol %. The reaction temperature can be in the range −40° C. to 150° C. Alternatively, the reaction temperature can be in the range of −20° C. to 100° C. The pressure can be in the range of atmospheric pressure to 8000 kPa. Alternatively, the pressure can be any pressure sufficient to keep the reactants in the liquid phase. Residence time of reactants in the reaction zone can be in the range of a few seconds to hours. More particularly, the residence time of reactants in the reaction zone can be in the range of 0.5 min to 60 min.

Typical alkylation conditions may include a catalyst volume in the reaction zone of from 5 vol % to 50 vol %, a temperature of from −10° C. to 100° C., a pressure of from 300 kPa to 2500 kPa, an isoparaffin to olefin molar ratio of 2 to 8 and a residence time of 1 minute to 1 hour.

System

Also disclosed herein is a system for the production of low volatility, high quality gasoline blending components. The system is based upon the reaction of at least one isoparaffin with at least one olefin in the presence of an ionic liquid catalyst to provide a product comprising gasoline blending components. The system comprises the following elements: (1) a reaction zone; (2) two or more reaction cells; (3) two or more nozzles; (4) a first conduit leading to the nozzles; (5) a second conduit leading to the nozzles; and (6) an exit conduit leading away from the reaction zone. The reaction zone includes the two or more reaction cells and two or more nozzles dispersed throughout the two or more reactions cells such that each reaction cell contains at least one nozzle. For example, the system can have three reaction cells, each with one nozzle. As another example, the system can have two reaction cells, each with two nozzles. The first conduit leading to the nozzles provides the at least one isoparaffin and/or the at least one olefin to all of the nozzles, while the second conduit leading to the nozzles provides ionic liquid catalyst to all of the nozzles. The exit conduit leading away from the reaction zone removes the product comprising the gasoline blending components from the reaction zone.

Optionally, the system includes a third conduit leading to the nozzles. The optional third conduit provides at least one isoparaffin and/or at least one olefin to all of the nozzles. If the system only has two conduits leading to the nozzles, the hydrocarbons (i.e. isoparaffin(s) and olefins(s)) flow through the first conduit and ionic liquid catalyst flows through the second conduit. However, if the system has three conduits leading to the nozzles, the three liquids are split between the three conduits. In other words, the at least one isoparaffin flows through the first conduit to the nozzles, the ionic liquid catalyst flows through the second conduit to the nozzles, and the at least one olefin flows through the third conduit to the nozzles.

In the system as described herein, the nozzles can be oriented within the reaction cells in any manner. The nozzles can be vertically oriented or horizontally oriented. If the nozzles are vertically oriented, the can face either upwardly or downwardly. The nozzles can also be oriented at any angle (e.g., 45 degrees).

The following examples are provided to better illustrate the advantages and/or embodiments of the process and/or system as discussed herein. The examples are meant only to be illustrative, and not limiting.

EXAMPLES

Example 1

$C_4$ Olefin and Isobutane Alkylation

Evaluation of $C_4$ olefin alkylation with isobutane was performed in a 100 cc continuously stirred tank reactor. 8:1 molar ratio of isobutane and 2-butene mixture was fed to the reactor while vigorously stirring at 1600 RPM. An ionic liquid catalyst, a $CaCl_2$ modified N-butylpyridinium chloroaluminate catalyst, was fed to the reactor via a second inlet port targeting to occupy 10-15 vol % in the reactor. A small amount of anhydrous HCl gas was added to the process. The average residence time (combined volume of feeds and catalyst) was about 8 minutes. The outlet pressure was maintained at 100 psig using a backpressure regulator.

The reactor temperature was maintained at 0° C. using external cooling. The reactor effluent was separated in a 3-phase separator into $C_4^-$ gas, alkylate hydrocarbon phase, and the ionic liquid catalyst. Detailed composition of alkylate gasoline was analyzed using gas chromatography. Research Octane number was calculated based on GC composition and Research Octane number of pure compounds assuming volumetric linear blending. Summary of operating conditions and performance are summarized in Table 1.

To study the effect of mixing on catalyst performance, the RPM was lowered to 800, 400, and 200 RPM. Product properties were measured at these different mixing conditions.

TABLE 1

Effect of Mixing on Alkylate Gasoline Properties

| | RPM of reactor stirring | | | |
|---|---|---|---|---|
| | 1600 | 800 | 400 | 200 |
| Olefin Source | 2-butene | 2-butene | 2-butene | 2-butene |
| Acid volume fraction | 0.15 | 0.15 | 0.15 | 0.15 |
| Temp., deg C. | 0 | 0 | 0 | 0 |
| External I/O ratio, molar | 8.0 | 8.0 | 8.0 | 8.0 |
| C5+ Gasoline Composition Calculation | | | | |
| C5 | 2.0 | 2.9 | 1.2 | 0.7 |
| C6 | 2.2 | 3.7 | 2.4 | 1.8 |
| C7 | 4.0 | 5.4 | 3.5 | 3.1 |
| C8 | 76.6 | 57.9 | 42.7 | 37.1 |
| C9 | 8.3 | 16.7 | 21.3 | 19.9 |
| C10 | 2.0 | 4.2 | 6.5 | 8.3 |
| C11+ | 4.8 | 9.2 | 22.4 | 29.2 |
| Sum | 100.0 | 100.0 | 100.0 | 100.0 |
| C5+ Gasoline Property Estimation | | | | |
| Average Molecular Weight | 116 | 119 | 130 | 136 |
| Research Octane Number | 93.3 | 90.5 | 89.5 | 88.9 |

The results in Table 1 clearly show that high octane alkylate can be obtained only at high RPM conditions, indicating a uniform mixing of isobutane and olefin is required to achieve good product quality. When mixing is poor, e.g., at lower RPM, undesirable side reactions such as oligomerization can dominate and the heavy yield increases drastically, from 4.8% C11+ at 1600 RPM, to 29.2% C11+ at 200 RPM.

Example 2

Droplet Size Distribution in Stirred Tank

The droplet size distributions of the catalyst phase produced in the 100 cc stirred tank reactor described in Example 2 are estimated by Visimix simulations to evaluate the effects of the droplet size distribution on the product quality. FIG. 1 shows the droplet size distribution obtained in the 100 cc reactor at different RPMs, and Table 2 lists the Sauter mean droplet size and the specific interfacial area.

TABLE 2

Effects of RPM on Mean Droplet Size and Interfacial Area (Estimated by Visimix Simulation)

| Parameter name | Units | 1600 RPM | 800 RPM | 400 RPM | 200 RPM |
|---|---|---|---|---|---|
| Sauter mean drop size | micron | 154 | 265 | 476 | 977 |
| Specific interfacial area | $m^2/m^3$ | 2340 | 1360 | 757 | 368 |

Obviously, from both FIG. 1 and Table 2, increasing the RPM of the stirred tank reactor will produce much finer catalyst droplets. When the RPM increases from 200 to 1600, the mean droplet size decreases from almost 1000 micron to 154 micron and the specific interfacial area is one order of magnitude larger. The larger specific interfacial area obtained at 1600 RPM contributes significantly to the better product quality as described in Example 2. Indeed, a larger interfacial area will certainly lead to a higher mass transfer rate and higher overall reaction rates. In a continuous stirred tank reactor, a higher reaction rate means a higher olefin conversion or a lower exit olefin concentration which considerably restrains side reactions such as oligomerization. Oligomerization is usually considered as a reaction with higher order than the alkylation reaction in terms of the olefin concentration.

Example 3

Droplet Size Distribution Produced by Nozzles

Evaluation of the nozzles on phase dispersion was performed in a cold flow unit. The experiments were conducted at ambient conditions using 2,2,4-Trimethyl Pentane (TMP) as the hydrocarbon phase and fresh ionic liquid as the catalyst phase. Two diaphragm pumps were used to feed the hydrocarbon phase and the catalyst phase into a tubular reactor thorough a BETE nozzle. This nozzle, mounted on the top of the tubular reactor which is filled with TMP, has two inlets, one outlet, and an internal mixing chamber. The two liquids, fed from the two separate inlets, thus mix in the internal chamber and exit from the outlet into the tubular reactor. Samples were taken from the top part of the reactor for droplet size distribution measurement.

Figure 2:
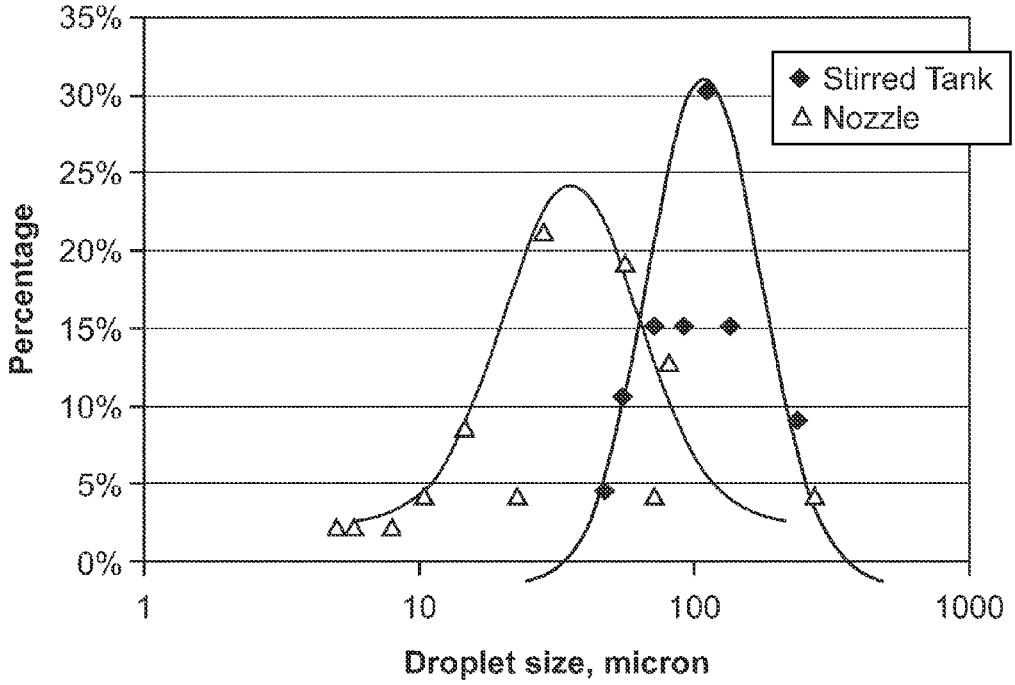
FIG. 2 graphically depicts a comparison of droplet size produced by a nozzle in Example 3 and droplet size produced in a stirred reactor in Example 2.

To compare the nozzles with stirred tank reactors in terms of the phase dispersion effects, the droplet size distribution produced in a 300 cc stirred tank reactor were also measured. This reactor is similar to the 100 cc reactor used in Example 2 and has produced comparable, if not better, product quality when used in alkylation reactions. The droplet size distribution measurement was conducted under ambient conditions using TMP and fresh ionic liquid at 1800 RPM. FIG. 2 exhibits the droplet size distribution obtained from the nozzle and the stirred tank reactor.

The nozzle produces smaller droplets than the stirred tank reactor does with a considerable amount of droplets less than 10 micron in size, which provides for a very large interfacial area. A much higher reaction rate and better product quality thus can be expected.

Although the process and system as disclosed herein have been described in connection with specific embodiments thereof, it will be appreciated by those skilled in the art that additions, deletions, modifications, and substitutions not specifically described may be made without departing from the spirit and scope of the process and system as defined in the appended claims.

That which is claimed is:

1. An alkylation process for the production of a reaction product, comprising:

contacting a plurality of liquid reactants and ionic liquid catalyst with one another in an internal chamber of at least one nozzle; and injecting the plurality of liquid reactants and the ionic liquid catalyst through the at least one nozzle into a reaction zone under reaction conditions to provide a reaction product, wherein the at least one nozzle is vertically oriented facing downwardly into the reaction zone;

wherein both the plurality of liquid reactants and the ionic liquid catalyst pass through the at least one nozzle and the nozzle produces ionic liquid catalyst droplets of about 10-100 microns; and wherein the ionic liquid catalyst is present in an amount of 5 vol % to 50 vol %.

2. A process for the production of low volatility, high quality gasoline blending components, comprising:

contacting at least one isoparaffin, at least one olefin, and an ionic liquid catalyst with one another in an internal chamber of at least one nozzle; and injecting the at least one isoparaffin, the at least one olefin, and the ionic liquid catalyst through the at least one nozzle into a reaction zone under alkylation conditions to provide a product comprising the low volatility, high quality gasoline blending components, wherein the at least one nozzle is vertically oriented facing downwardly into the reaction zone;

wherein each of the at least one isoparaffin, the at least one olefin, and the ionic liquid catalyst all pass through the at least one nozzle and the nozzle produces ionic liquid catalyst droplets of about 10-100 microns; and wherein the ionic liquid catalyst is present in an amount of 5 vol % to 50 vol %.

3. The process according to claim 2, wherein each of the at least one isoparaffin, the at least one olefin, and the ionic liquid catalyst are injected simultaneously through the at least one nozzle.

4. The process according to claim 2, wherein the at least one nozzle is two or more nozzles and the at least one isoparaffin, the at least one olefin, and the ionic liquid catalyst are injected concurrently through the two or more nozzles.

5. The process according to claim 2, further comprising:

removing the product from the reaction zone; and isolating the low volatility, high quality gasoline blending components.

6. The process according to claim 2, wherein the at least one nozzle is a plurality of nozzles disposed within a single reactor, all vertically oriented facing downwardly.

7. The process according to claim 2, wherein the reaction zone is comprised of a plurality of reaction cells, and at least one nozzle is disposed within each reaction cell.

8. The process according to claim 2, wherein the at least one olefin is selected from the group consisting of ethylene, propylene, butene, pentene, and mixtures thereof.

9. The process according to claim 2, wherein the at least one isoparaffin is selected from the group consisting of isobutane, isopentane, and mixtures thereof.

10. The process according to claim 2, wherein the ionic liquid catalyst is selected from the group consisting of:

a first chloroaluminate ionic liquid catalyst comprising a hydrocarbyl substituted pyridinium halide of the general formula A and aluminum trichloride or a hydrocarbyl substituted imidazolium halide of the general formula B and aluminum trichloride;

a second chloroaluminate ionic liquid catalyst comprising an alkyl substituted pyridinium halide of the general formula A and aluminum trichloride or an alkyl substituted imidazolium halide of the general formula B and aluminum trichloride;

and mixtures thereof, wherein the general formula A and the general formula B are represented by the structures:

(A)

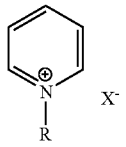

(B)

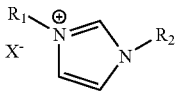

wherein R═H, methyl, ethyl, propyl, butyl, pentyl or hexyl group and X is a haloaluminate, and $R_1$ and $R_2$═H, methyl, ethyl, propyl, butyl, pentyl, or hexyl group and where $R_1$ and $R_2$ may or may not be the same.

11. The process according to claim 10, wherein the first chloroaluminate ionic liquid catalyst is prepared by combining 1 molar equivalent of the hydrocarbyl substituted pyridinium halide or the hydrocarbyl substituted imidazolium halide with 2 molar equivalents of aluminum trichloride.

12. The process according to claim 10, wherein the second chloroaluminate ionic liquid catalyst is prepared by combining 1 molar equivalent of the alkyl substituted pyridinium halide or the alkyl substituted imidazolium halide with 2 molar equivalents of aluminum trichloride.

13. The process according to claim 10, wherein the ionic liquid catalyst is selected from the group consisting of 1-butyl-4-methyl-pyridinium chloroaluminate (BMP), 1-butyl-pyridinium chloroaluminate (BP), 1-butyl-3-methyl-imidazolium chloroaluminate (BMIM), 1-H-pyridinium chloroaluminate (HP), and N-butylpyridinium chloroaluminate, and mixtures thereof.

14. The process according to claim 10, wherein the ionic liquid catalyst further comprises an HCl co-catalyst.

15. The process according to claim 2, wherein the at least one nozzle results in better mixing and interfacial contact between the at least one isoparaffin, the at least one olefin, and the ionic liquid catalyst in the reaction zone as compared to an alkylation process where the at least one isoparaffin, the at least one olefin, and the ionic liquid catalyst are not all injected through the same at least one nozzle into the reaction zone.

16. A system for the production of low volatility, high quality gasoline blending components comprising:

(a) a reaction zone;

(b) two or more reaction cells within the reaction zone, wherein at least one isoparaffin is reacted with at least one olefin in the presence of an ionic liquid catalyst under alkylation conditions to produce a product comprising the low volatility, high quality gasoline blending components, wherein the ionic liquid catalyst is present in an amount of 5 vol % to 50 vol %;

(c) at least one nozzle vertically oriented downwardly within each of the reaction cells such that the system comprises two or more nozzles, wherein each nozzle has an internal chamber;

(d) a first conduit leading to the nozzles for injecting the at least one isoparaffin and/or the at least one olefin through all of the nozzles;

(e) a second conduit leading to the nozzles for injecting the ionic liquid catalyst through all of the nozzles, wherein the nozzle produces ionic liquid catalyst droplets of about 10-100 microns;

(f) at least one exit conduit leading away from the reaction zone; and (g) optionally a third conduit leading to the nozzles for injecting the at least one isoparaffin and/or the at least one olefin through all of the nozzles.

* * * * *